US009080734B2

(12) United States Patent
Andersen et al.

(10) Patent No.: US 9,080,734 B2
(45) Date of Patent: Jul. 14, 2015

(54) MODULAR FLASH LIGHT WITH MAGNETIC CONNECTION

(71) Applicants: Cade Andersen, Kaysville, UT (US); Brian Andersen, Centerville, UT (US)

(72) Inventors: Cade Andersen, Kaysville, UT (US); Brian Andersen, Centerville, UT (US)

( * ) Notice: Subject to any disclaimer, the term of this patent is extended or adjusted under 35 U.S.C. 154(b) by 0 days.

(21) Appl. No.: 14/268,310

(22) Filed: May 2, 2014

(65) Prior Publication Data

US 2014/0328054 A1 Nov. 6, 2014

Related U.S. Application Data

(60) Provisional application No. 61/819,518, filed on May 3, 2013.

(51) Int. Cl.

| | |
|---|---|
| ***F21L 4/00*** | (2006.01) |
| ***H01R 13/62*** | (2006.01) |
| *F21L 2/00* | (2006.01) |
| *F21V 17/00* | (2006.01) |
| *H01R 11/30* | (2006.01) |
| *F21Y 101/02* | (2006.01) |

(52) U.S. Cl.

CPC . *F21L 4/00* (2013.01); *F21L 4/005* (2013.01); *H01R 13/6205* (2013.01); *F21L 2/00* (2013.01); *F21V 17/002* (2013.01); *F21Y 2101/02* (2013.01); *H01R 11/30* (2013.01)

(58) Field of Classification Search

USPC ..... 362/194, 184, 189, 195, 197–200, 362/202–204, 208

See application file for complete search history.

(56) References Cited

U.S. PATENT DOCUMENTS

| | | | | |
|---|---|---|---|---|
| 3,786,391 | A | 1/1974 | Mathauser | |
| 4,390,232 | A | 6/1983 | Jamgotchian | |
| 5,401,175 | A | 3/1995 | Guimond et al. | |
| 6,217,339 | B1 | 4/2001 | Tsubata | |
| 6,267,602 | B1 | 7/2001 | Mendelson et al. | |
| 6,976,882 | B2 | 12/2005 | Kernan | |
| 7,264,479 | B1 | 9/2007 | Lee | |
| 7,344,267 | B2 * | 3/2008 | Carito | 362/189 |
| 7,351,066 | B2 | 4/2008 | DiFonzo et al. | |
| 7,402,045 | B2 | 7/2008 | Schwartzbart et al. | |
| 7,625,213 | B1 | 12/2009 | Tse | |
| 7,641,476 | B2 | 1/2010 | Didur et al. | |
| 7,758,349 | B2 | 7/2010 | Han et al. | |
| 7,789,667 | B2 | 9/2010 | Zhu et al. | |
| 7,871,272 | B2 | 1/2011 | Firman et al. | |
| 7,874,844 | B1 | 1/2011 | Fitts | |
| 8,058,957 | B2 | 11/2011 | Irion et al. | |
| 2005/0255718 | A1 | 11/2005 | McLeish | |
| 2007/0114969 | A1 | 5/2007 | Marmaropoulos | |
| 2007/0161262 | A1 | 7/2007 | Lloyd | |
| 2007/0253195 | A1 * | 11/2007 | Dietz | 362/203 |
| 2011/0159705 | A1 | 6/2011 | Schmidt | |
| 2011/0171837 | A1 | 7/2011 | Hardisty et al. | |
| 2012/0162992 | A1 * | 6/2012 | Hu et al. | 362/253 |

* cited by examiner

*Primary Examiner* — Laura Tso

(74) *Attorney, Agent, or Firm* — Pate Peterson PLLC; Brett Peterson

(57) ABSTRACT

A modular lighting system with a magnetic plug and socket connection between a battery module, light module, and other modules is provided. The plug and socket include magnets which are attached magnetically to each other to hold the battery module and light module together. Electricity is transmitted through the magnets to power the light module. The connection system allows a user to easily customize the lighting system to meet different needs.

18 Claims, 10 Drawing Sheets

MODULAR FLASH LIGHT WITH MAGNETIC CONNECTION

PRIORITY

The present application claims the benefit of U.S. Provisional Application Ser. No. 61/819,518, filed May 3, 2013, which is herein incorporated by reference in its entirety.

THE FIELD OF THE INVENTION

The present invention relates to flashlights. More specifically, the present invention relates to a modular magnetic connection for use with flashlights and the like.

BACKGROUND

People often have several flashlights as each flashlight has a different purpose. Different flashlights may be selected for different power levels, beam patterns, etc. While accommodating the desired uses, having multiple flashlights increases the space necessary to keep these flashlights and increases the number of batteries that the user must maintain.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. The drawings are drawn to scale to allow for better understanding of the structures and components thereof.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Figure 1:
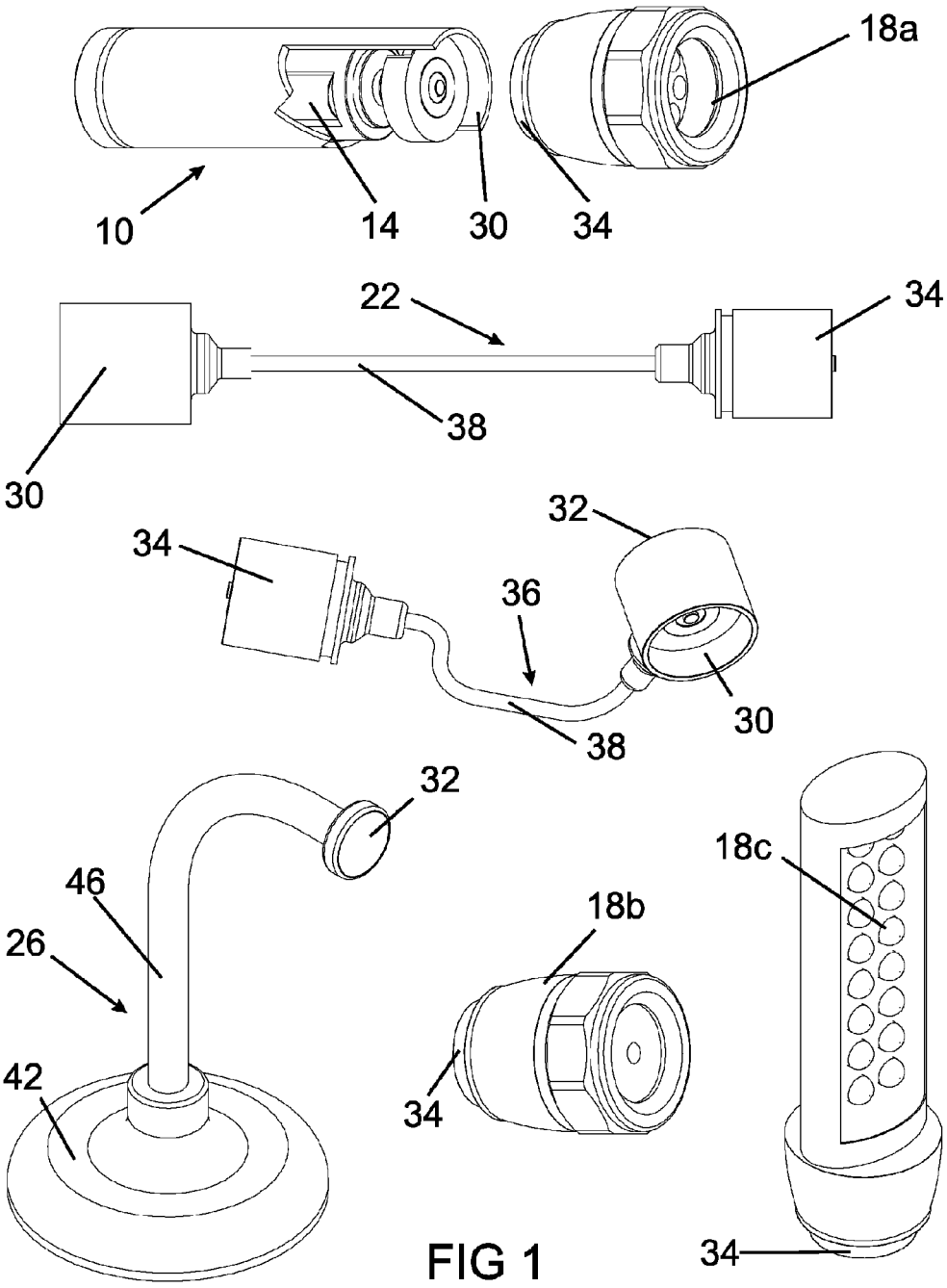
FIG. 1 shows a drawing of a modular flashlight system.

Turning now to FIG. 1, a drawing of a modular flashlight system 10 according to the present invention is shown. The modular flashlight system includes various interchangeable parts to allow a user to configure a flashlight in a desired manner. The system 10 may include a battery module 14, a light module 18 (the system may include various different interchangeable light modules 18A, 18B, 18C, etc.), an extension module 22, or a magnetic base module 26. Each of the modules may interconnect via sockets 30 and plugs 34. The plugs 34 are held within the sockets 30 with a magnet. A user may place a plug 34 into a socket 30 to connect two modules together both physically and electrically. Any plug 34 may be placed into any socket 30. In this manner, a user may select a desired combination of modules for use when the user needs a flashlight.

A user may connect a battery module 14 to a light module 18A, 18B, 18C by placing the light module plug 34 into the battery module socket 30, thereby creating a flashlight. The user may select a desired light module 18A, 18B, 18C and connect this light module to the battery module 14 to create a different flashlight as desired. Different light modules 18A, 18B, 18C may provide different lighting options to the user.

A user may also combine the battery module 14 and a light module 18 with other modules to vary the use of the flashlight. The extension module 22 may include a socket 30 and a plug 34 which are connected to each other physically and electrically with a length of wire 38. The plug 34 of the extension module 22 may be connected to the socket 30 of the battery module 14 and the plug 34 of a light module 18 connected to the socket 30 of the extension module 22 to create a flashlight with a length of flexible electrical cord between the battery module 14 and the light module 18. This may allow the user to place the battery module 14 in a desired location which is remote from the area illuminated by the light module 18 due to space, heat, weight, or other concerns.

The magnetic base module 26 may include a magnetic face 32 (e.g. a magnet) which is connected to a base/magnetic base 42 (which may also contain a magnet to allow the base 42 to be attached to other structures) via a flexible arm 46. An extension module or adapter module 36 may also include a magnetic face 32 (e.g. a magnet) which attaches to the magnetic face 32 of the magnetic base module 26. The adapter 36 may include a socket 30 for attachment to a light module 18 as well as a cord wire 38 and plug 34 for connection to a battery module 14. A magnet 32 may be attached opposite the socket 30.

The adapter 36 may allow a light 18 to be attached to the base module 26 and used as a lamp without requiring the bulk of the battery module 14 to be positioned immediately adjacent the light module 18 and base module 26. The flexible arm 46 may include a number of pivot joints or a continuously flexible section to allow a user to aim the light 18 in a desired direction. A user may connect the plug 34 of a light module 18 to the socket 30 of the adapter 36. The plug 34 of the adapter 36 may be connected to the battery module 14 and the magnet 32 on the adapter 36 may be attached to the magnet 32 on the base 26. In this example, the magnetic base module 26 may serve as a mechanical connection for positioning the light module 18. A magnetic base 42 may be attached to a metal/magnetic object to position the light module 18 in a desired position. The magnetic base module 26 may thus be used to hold and position the light 18. The adapter 36 may also allow a user to secure a light to another metal object. A user may connect the plug 34 of a light module 18 to the socket 30 of the adapter 36. The plug 34 of the adapter 36 may be connected to the battery module 14 and the magnet 32 on the adapter 36 may be attached to an iron or steel object to secure a light 18 to that object as a portable task light.

Figure 2:
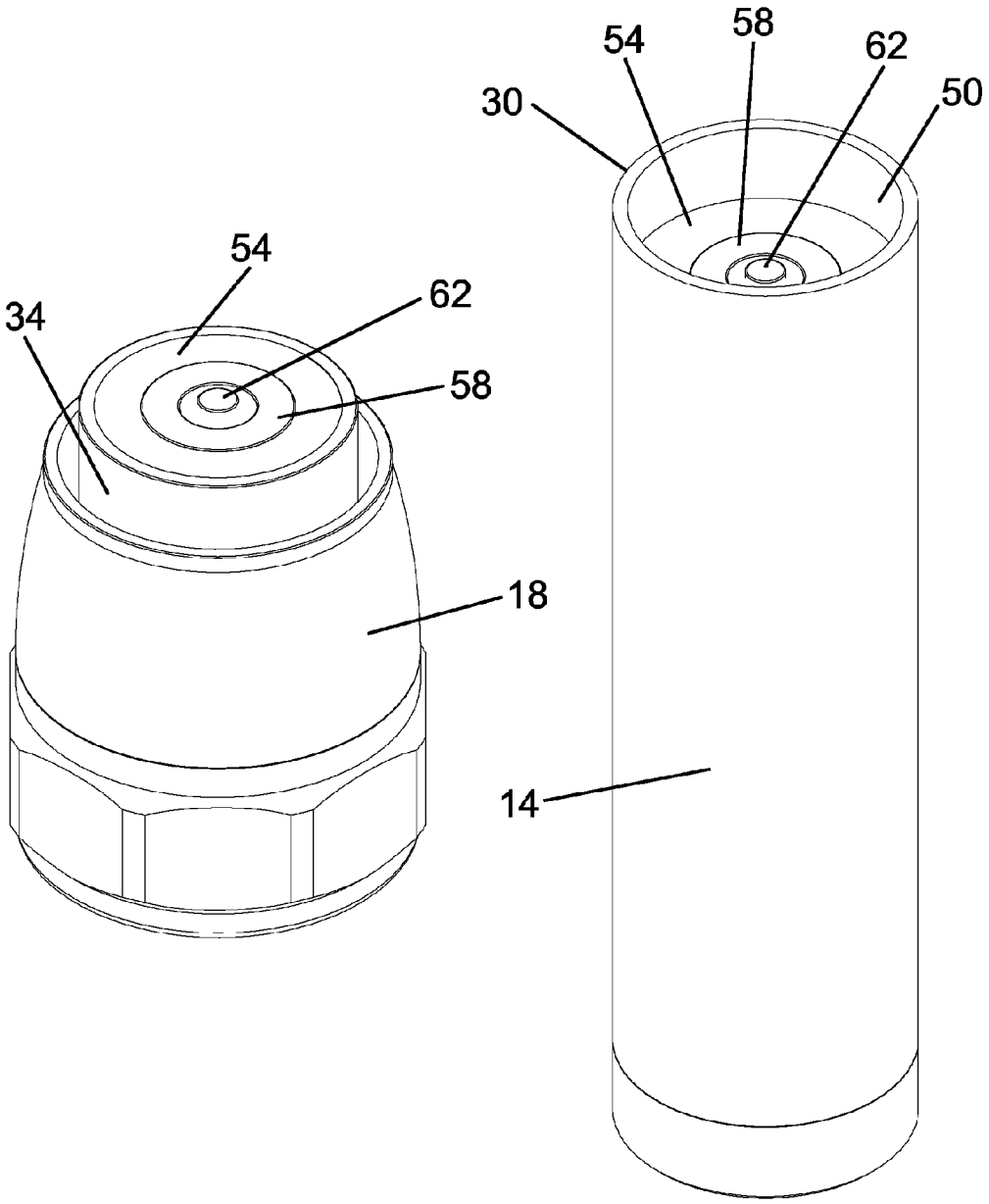
FIG. 2 shows a drawing of a magnetic socket and plug.

Referring now to FIG. 2, a drawing of a battery module 14 and light module 18 with emphasis on the socket 30 and plug 34 is shown. The socket 30 may include a cylindrical shroud or wall 50 which extends forwards from a body (such as the body of the battery module 14) and defines the socket 30. The shroud 50 may be metal, and may be formed from the body material of the module which the socket 30 is part of (e.g. the battery module). The socket 30 may include an insulating plate 54 which holds a ring magnet 58 and a pin 62. The insulating plate 54 may be formed from a plastic, polymer, phenolic, etc. The insulating plate 54 may be disposed a distance inside of the shroud 50 so that it is recessed from the end of the shroud 50 and protected from accidental contact which may short the magnet 58 and pin 62. The pin 62 may be located in the center of the ring magnet 58 (in a hole formed through the ring magnet).

The insulating plate may be made of a material such as phenolic which electrically isolates the ring magnet 58 and the pin 62. The insulating plate 54 may include a ring shaped recess which receives the ring magnet 58 and a hole through the center of the ring shaped recess to allow the pin 62 to pass through the plate 50. This holds the ring magnet 58 and pin 62 in position and electrically isolates them from each other. The ring magnet 58 and the pin 62 may each form part of an electrical connection. The socket 30 may be formed such that the shroud 50 is not part of the electrical connection. The socket 30 is typically used for an electrical connection which may be electrically hot when it is not connected (i.e. the battery module 14 as compared to a light module 18) while the plug 34 is typically used for a part such as a light 18 which is plugged into a power module. This protects from accidental contact with live electrical leads as the electrical contacts in the socket 30 are recessed.

The plug 34 may also include a similar insulating plate 54 which holds a ring magnet 58 and a pin 62. The plug insulating plate 54 may be disposed at the end of the plug 34. The pin 62 may be located in hole in the center of the ring magnet 58. The insulating plate may be made of a material such as plastic, polymer, or phenolic which electrically isolates the ring magnet 58 and the pin 62. The plug 34 is sized to fit inside of the socket 30 and may be inserted into the sleeve 50 so that the pins 62 and magnets 58 contact each other. The ring magnet 58 and the pin 62 may each form part of an electrical connection. When the plug 34 is inserted into the socket 30, the pins 62 of the plug and socket contact each other and the ring magnets 58 of the plug and socket contact each other to complete at least a portion of an electrical circuit. While shown as part of the battery module 14 and light 18, each of the various plugs 34 and sockets 30 have the same structure and functionality as described.

Figure 3A:
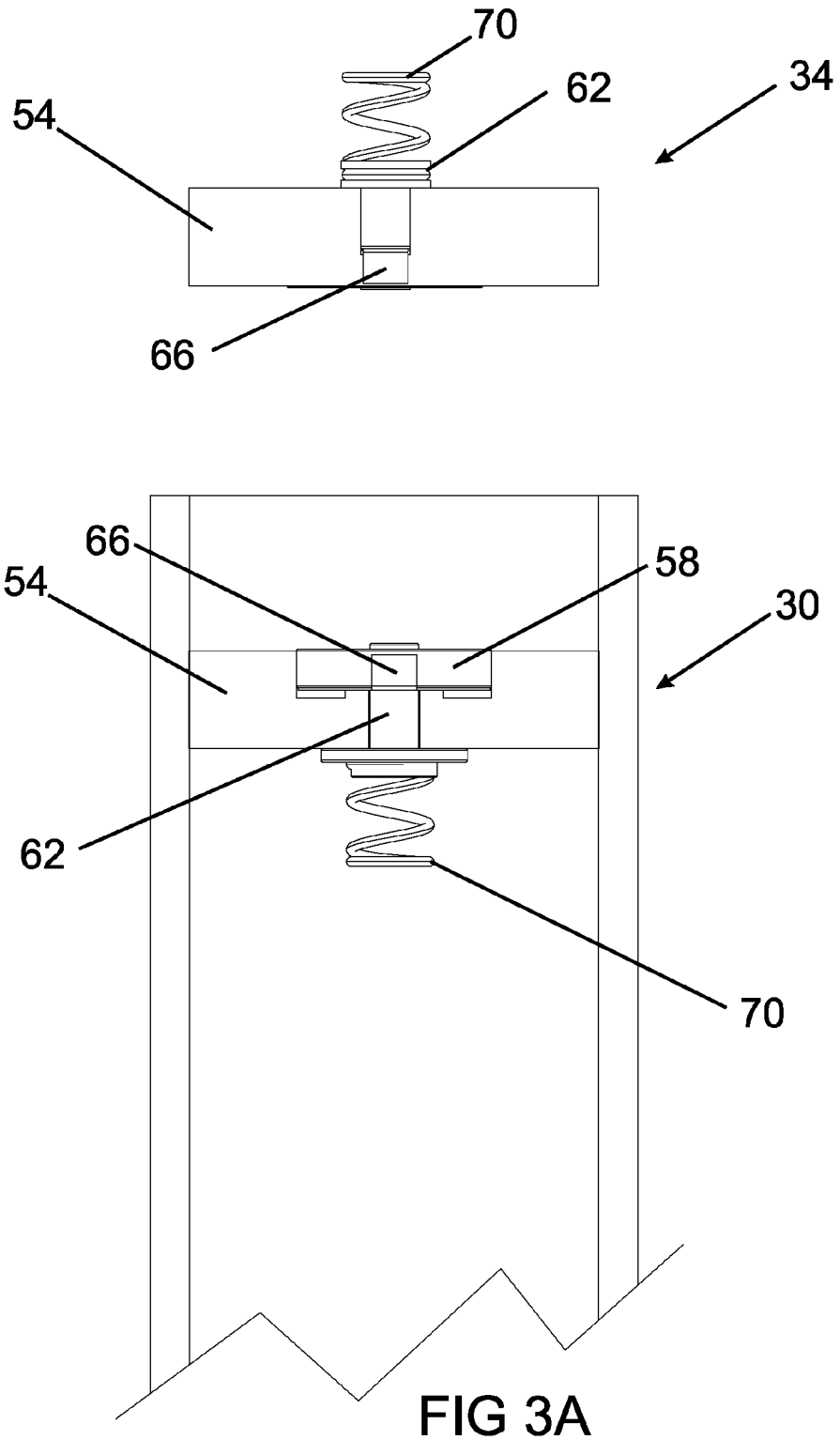
FIGS. 3A and 3B show drawings of parts of a socket or plug.
Figure 3B:
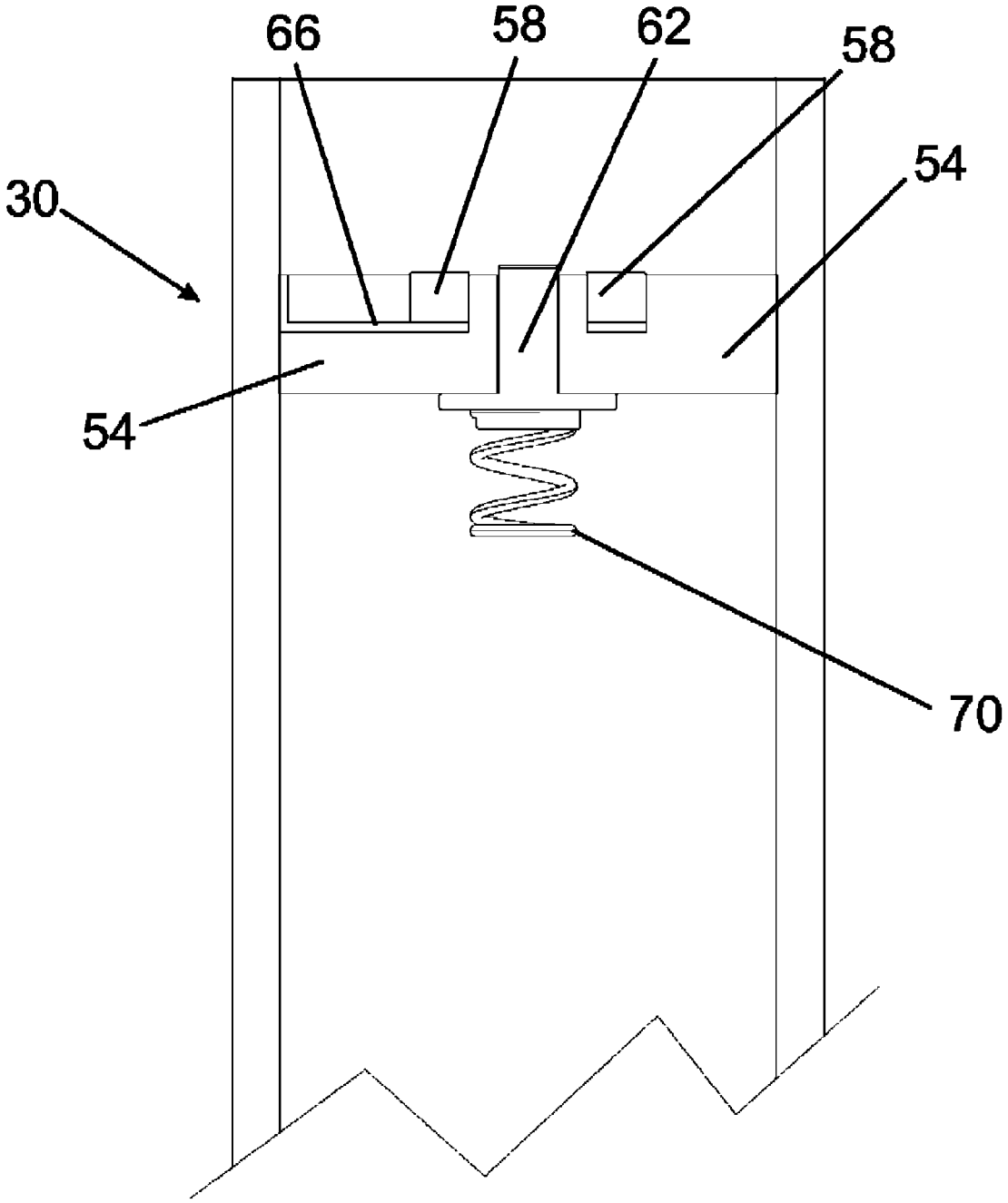

Referring now to FIGS. 3A and 3B, partially cut-away drawings of portions of a plug 34 and socket 30 is shown. The plug 34 is shown without any body or surrounding structures. The socket 30 is shown with the insulating plate 54 and any case or body cut through to show the magnet 58 and pin 62. FIG. 3B shows the socket 30 with the insulating plate, magnet 58, and pin 62 all cut through. The ring magnet 58 may be recessed into the surface of the insulating plate 54 and attached thereto. A contact plate 66 (such as a brass or copper contact plate) may be attached to the back of the ring magnet 58 with a conductive adhesive or other suitable means. The contact plate 66 may be used to facilitate electrically connecting the ring magnet 58 to a wire or the like for completion of an electrical circuit. If desired, the contact plate 66 may have an arm which extends laterally from the magnet 58 and contacts the body of the device to conduct electricity therethrough or is attached to a wire, etc. The magnet 58 may be rigidly mounted in the insulating plate 54 such as in a circular groove formed in the insulating plate 54. For a flashlight battery module 14, the contact plate 66 often contacts the inside of a metal body or case of the battery module and transmits electricity therethrough.

The pin 62 is typically mounted in a hole which extends through the insulating plate 54. A distal end of the pin 62 is exposed and extends beyond the insulating plate 54 in order to contact another pin 62 and form an electrical connection. A proximal end of the pin 62 extends through the insulating plate and is located on the inside of the associated module. The proximal end of the pin is typically connected electrically to a battery, wire, LED, etc. which is part of the module. A spring 70 may be attached to the proximal end of the pin 62 and may be used to push the pin 62 forwards. The spring 70 may push the pin 62 forwards beyond the surface of the insulating plate 54 and ensure a good electrical contact with an adjacent pin 62. As such, the pin 62 may include a cylindrical body portion which extends through an opening in the insulating plate, a flange which extends from the proximal end of the cylindrical body portion and engages the insulating plate 54 to prevent the pin from extending through the insulating plate too far, and a spring mount used to secure the spring 70 to the pin 62. The spring 70 may press against a wall or other internal structure in a module to provide some force in biasing the pin 62 to extend outwardly from the insulating plate 54. For a battery module 14, the spring 70 may press against a battery or battery pack which is placed into the body of the battery module, forming an electrical connection with the battery.

In some examples, the spring 70 may not be necessary. For example, the socket 30 may be use a spring 70 in combination with a pin 62 while the post 34 uses only a pin 62 or similar electrical contact. Additionally, the magnetic field from the ring magnet 58 tends to center the pin 62 within the ring magnet longitudinally. If the pin 62 is made of a material which is attracted to a magnet, formed in an appropriate length (typically longer than the thickness of the ring magnet 58), and moves freely within a hole in the insulating plate 54, the ring magnet 58 will cause the pin 62 to protrude beyond the surface of the insulating plate 54.

When a socket 30 and plug 34 are connected, the opposed ring magnets 58 contact each other and hold the socket and plug together. The ring magnets 58 form an electrical connection to complete part of a circuit. The adjacent pins 62 are also held together and form an electrical connection to complete part of a circuit.

Figures 4A, 4B:
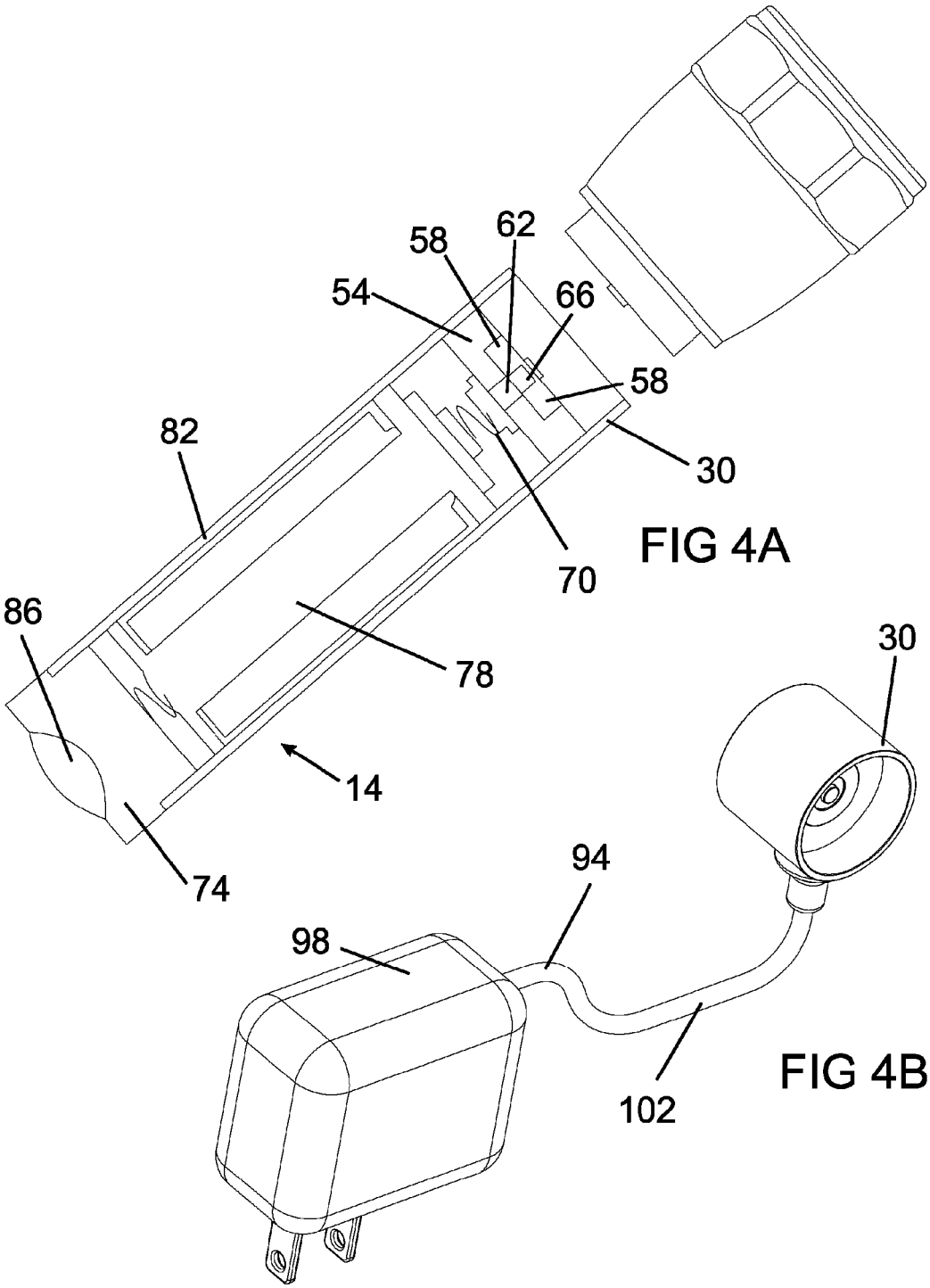
FIG. 4A shows a schematic drawing of a battery module.
FIG. 4B shows a drawing of a charging module.
Figure 5A:
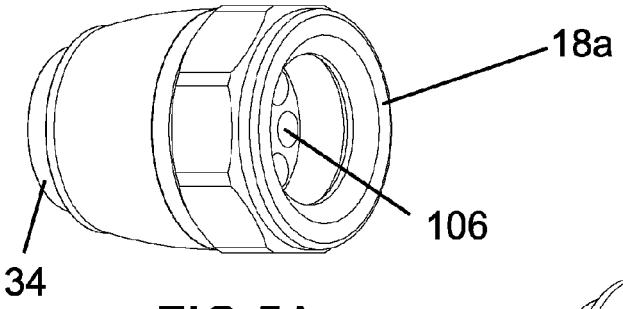
FIGS. 5A through 5D show drawings of light modules.
Figure 5B:
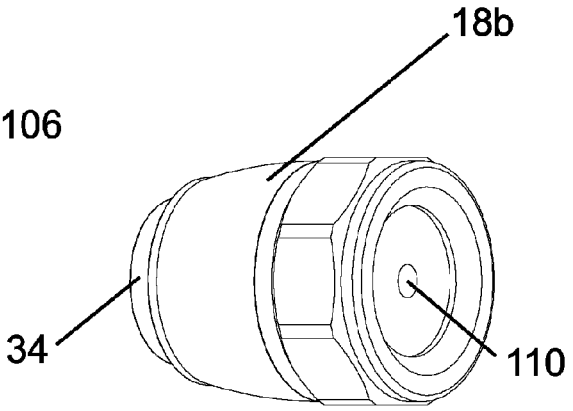
Figure 5C:
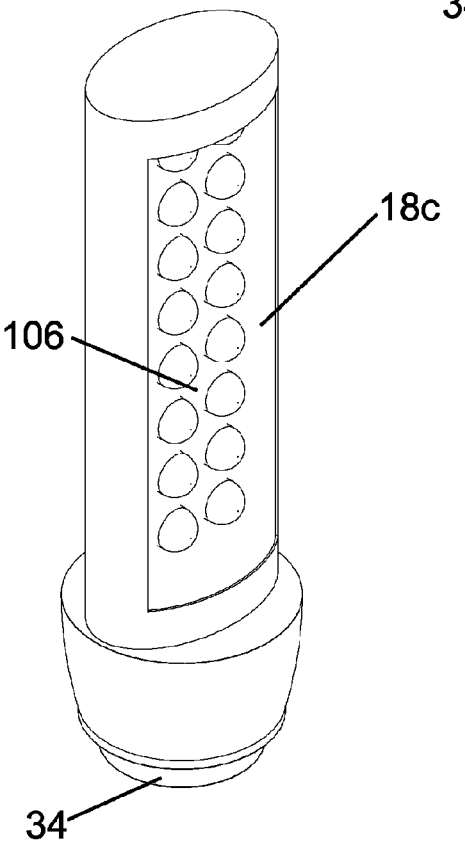
Figure 5D:
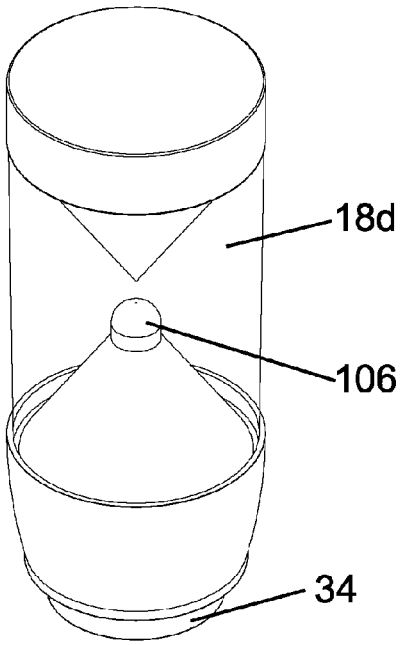

Referring now to FIG. 4A, a schematic view of the battery module 14 is shown. The socket 30 is formed as described herein. The battery module 14 may include a cap 74 which may be threaded and screw into or which may be otherwise attached to the battery module 14 to allow a battery 78 to be inserted into the body 82 of the battery module 14. The battery 78 may include one or more individual battery cells to provide a desired voltage. The battery 78 may be electrically connected to the pin 62 via the spring 70. The battery 78 may be electrically connected to the ring magnet 58 via the cap 74 and attached spring, a switch 86, the body 82 of the battery module 14, and a contact plate 66 or wire which is attached to the ring magnet 58. In this configuration, the cap 74 may include a switch 86 such as a push button switch which may be selectively closed to complete an electrical circuit between the battery 78 and the ring magnet 58. When the switch 86 is closed, the ring magnet 58 and pin 62 are connected to the battery 78 and a light module 18 or other module connected thereto may be provided with electrical energy from the battery.

Referring to FIG. 4B, A power supply module 94 may be provided. The power supply module 94 may include a power source 98 such as a transformer which connects to a wall electrical outlet and which is connected to a socket 30 by a wire 102. A light module 18 may be connected to the power supply module 94 by connecting the light module plug 34 to the power supply module socket 30 to thereby power the light module 18. Alternatively, a power supply module 94 may be formed with a plug 34 or other electrical contact which may be connected to the battery module 14 to charge the batteries.

Referring now to FIGS. 5A through 5D, drawings illustrating different light modules 18 are shown. By way of example, light module 18A may include an array of LEDs (Light Emitting Diodes) 106 to provide a desired level of illumination. Light module 18B may include a light bulb or a high output LED 110 to provide an increased level of illumination or to provide a different beam pattern. Light module 18C may include an array of LED lights 106 which are mounted in an array on a lateral face of a wand shaped body to provide light output which may be more convenient to use than the forward facing array of the light module 18A in some situations. Light module 18D may include a LED 106 and lens or reflector which provides light radially outward around the sides of the light module similar to a lantern. Different light modules 18 may be provided to provide different light beam patterns to a user.

Figure 6:
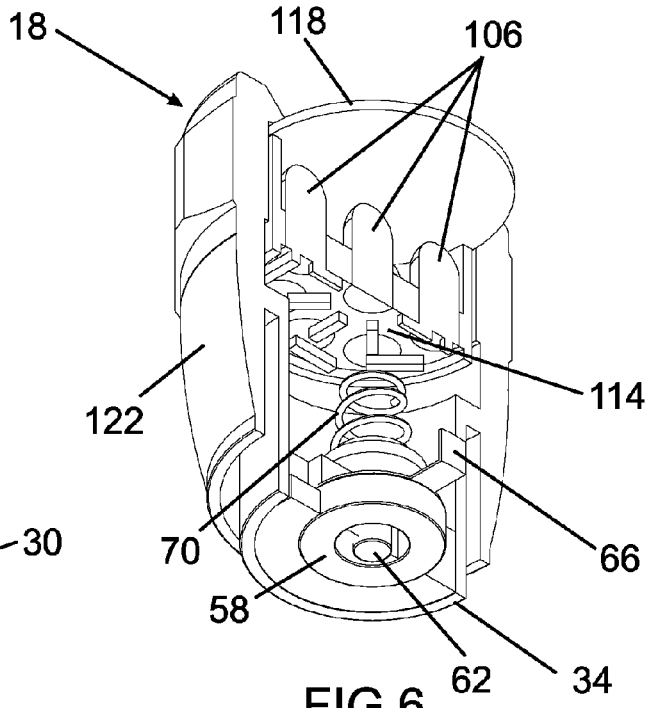
FIG. 6 shows a drawing of a light module.

Referring now to FIG. 6, a schematic drawing of an exemplary light module 18 is shown. The light module 18 may include a plug 34 as described herein. The light module 18 may include one or more LEDs 106 which may be mounted to a support plate or circuit board 114. A lens 118 may be used to protect the LEDs 106, focus the light from the LEDs, etc. The LEDs 106 may be connected electrically to the ring magnet 58 and pin 62 by wires or other structures. In one example, the LEDs may be electrically connected to the pin 62 by a spring 70 and to the ring magnet 58 by a contact plate 66. The light module 18 may include additional electronic components such as a resistor 130 (FIG. 9), wires, etc. as are desirable to provide functionality to the LEDs 106. The light module 18 may include a body 122 which houses the necessary components.

Figure 7:
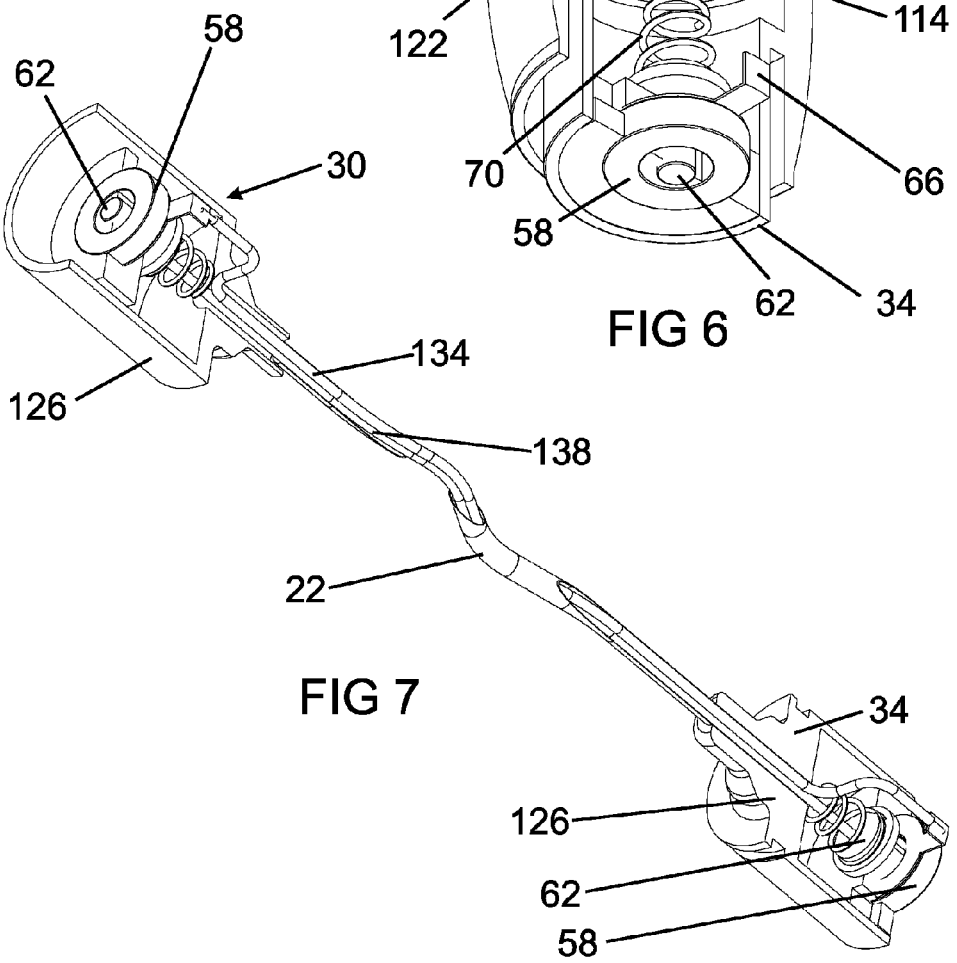
FIG. 7 shows a drawing of an extension module.

Referring now to FIG. 7, a schematic drawing of an exemplary extension module 22 is shown. The extension module 22 may include a socket 30 and plug 34 as discussed herein. The extension module 22 may include ring magnets 58 and pins 62 in the socket 30 and plug 34 which are connected by wires 134, 138. The wires 134, 138 may be attached to the ring magnets 58 via contact plates 66 and the pins 62 may use springs 70 as discussed herein. The socket 30 and plug 34 may each include a body 126 which houses the necessary components, forms part of the socket 30 and plug 34, and provides a user interface whereby a person may grasp and use the extension module 22.

Figure 8:
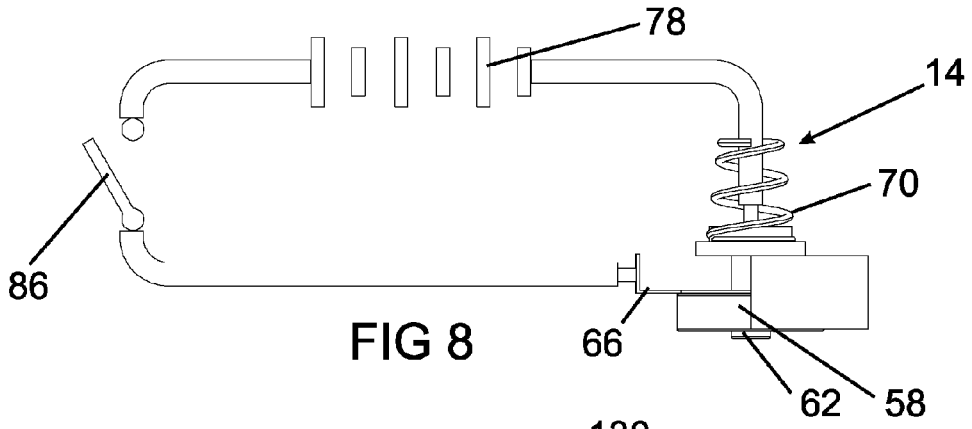
FIG. 8 shows a schematic drawing of a battery module.
Figure 9:
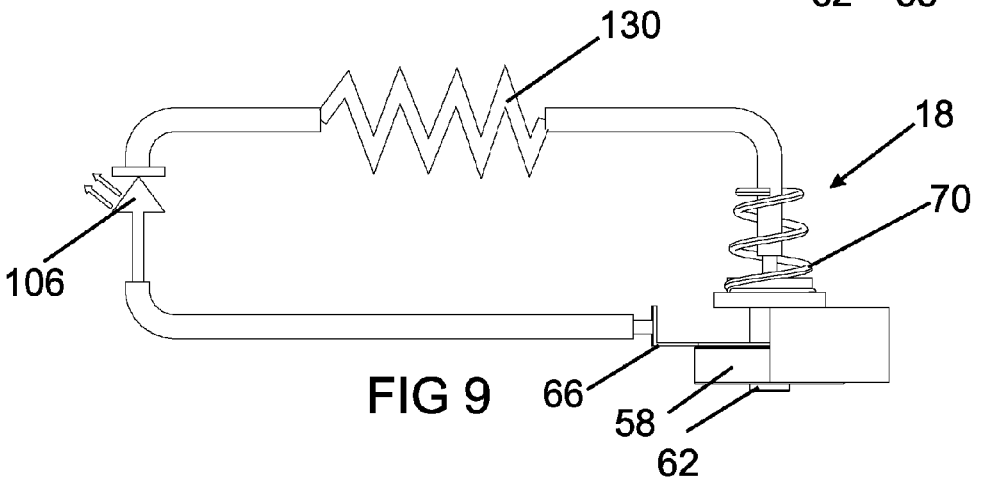
FIG. 9 shows a schematic drawing of a light module.
Figure 10:
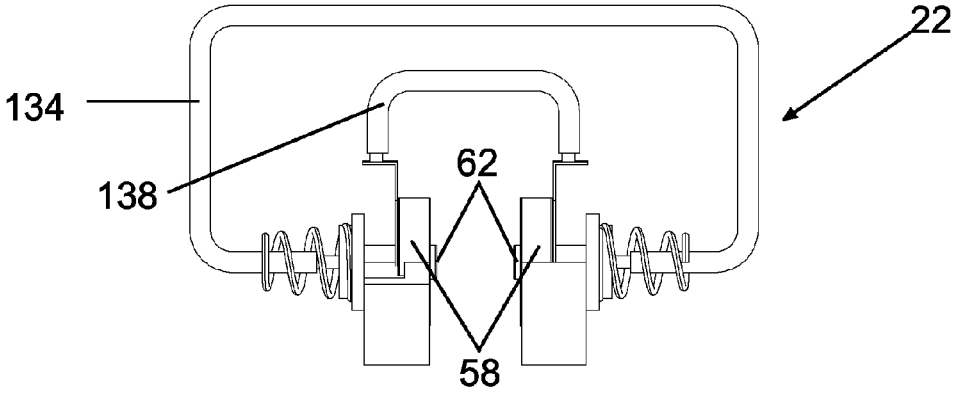
FIG. 10 shows a schematic drawing of an extension module.
Figure 11A:
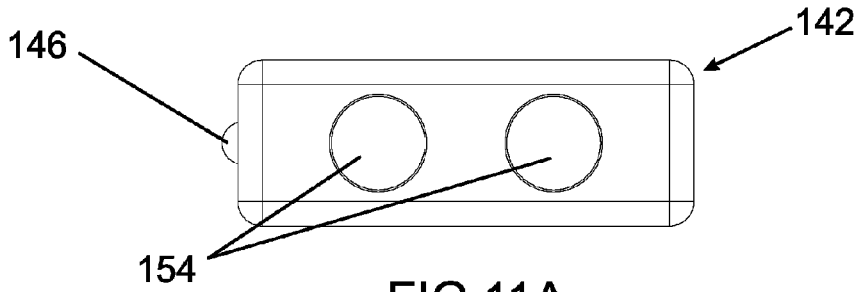
FIGS. 11A, 11B, and 12 show drawings of a magnetic light.
Figure 11B:
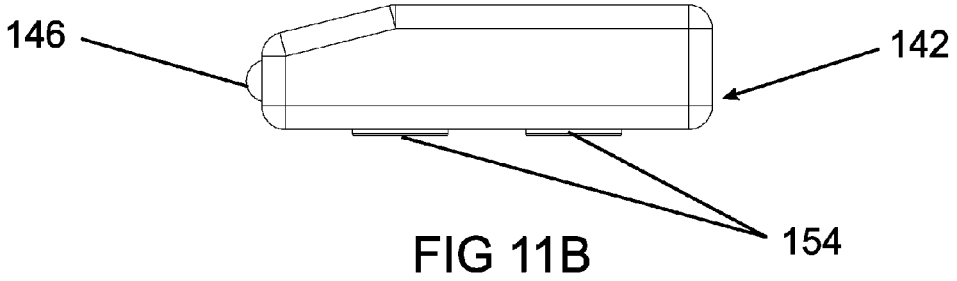

Referring now to FIGS. 8, 9, and 10, exemplary circuit schematics of the battery module 14, light module 18, and extension module 22 in accordance with FIGS. 4, 6, and 7, respectively are shown. As shown in FIG. 8, a battery module 14 may include a battery 78 and switch 86. The battery 78 and switch 86 may be connected to the ring magnet 58 and pin 62 via a contact plate 66 and spring 70 as well as wires or the body 82. As shown in FIG. 9, a light module 18 may include an LED 106 and a resistor 130 as well as any necessary wires or components to connect the LED 106 to the resistor 130 and to the ring magnet 58, pin 62, contact plate 66, and spring 70. The LED 106, resistor 130, and necessary electrical connections may all be formed as part of a circuit board 114. As shown in FIG. 10, an extension module 22 may include ring magnets 58 which are connected to each other via contact plates 66 and a wire 138 and may also include pins 62 which are connected to each other via springs 70 and a wire 134. An adapter module 36 as shown in FIG. 1 may be mechanically and electrically similar to the extension module 22 shown in FIGS. 1, 7, and 10 and may primarily differ in the mechanical inclusion of a magnet 32 to allow the socket 30 to be secured magnetically to a stand or other object for use. If the magnet 32 is placed generally opposite the socket 30 as is shown in FIG. 1, the wire 38 (with individual wires 134, 138) may be routed out the side of the body 126 as needed. The modular lighting system is advantageous as it allows a significant amount of flexibility in selecting a desired light module 18, coupling this with a desired power source, and mounting the light module in a location which is convenient for use. A person may have a number of functionally different lights without maintaining a number of different batteries, etc.

Referring now to FIGS. 11 through 14, various drawings of a light module 142 are shown. FIGS. 11A and 11B shows drawings of the light 142. The light 142 includes a light source such as an LED 146, an internal battery 150, and two magnets 154 which are all mounted to the body of the light 146. One terminal of the battery 150 is connected to one leg (i.e. the anode or cathode) of the LED 146 (frequently via a resistor, wire, or other electrical component) and the other electrical leg of the LED is connected to one of the magnets 154. The other terminal of the battery 150 is connected to the other of the magnets 154. When the two magnets 154 are electrically connected to each other (such as by attaching the magnets 154 to an electrically conductive surface) the circuit is completed and the LED 146 is illuminated.

In this manner, the LED 146 may be illuminated by attaching both of the magnets 154 to a piece of metal such as a screwdriver or a work piece. Attaching the light 142 to a tool such as a screwdriver will provide illumination directly where a person is working with the tool without requiring the person to hold a light. The light 142 is quite small (i.e. about an inch long and less than half of an inch wide) and may thus be used as a convenient tool light without obscuring vision of the location where the tool is being used. The light 142 may also be attached to a steel or iron object adjacent where a person is working to illuminate the work area. The light 142 is sufficiently small to attach in many locations without interfering with a person's ability to work in that location.

Figure 12:
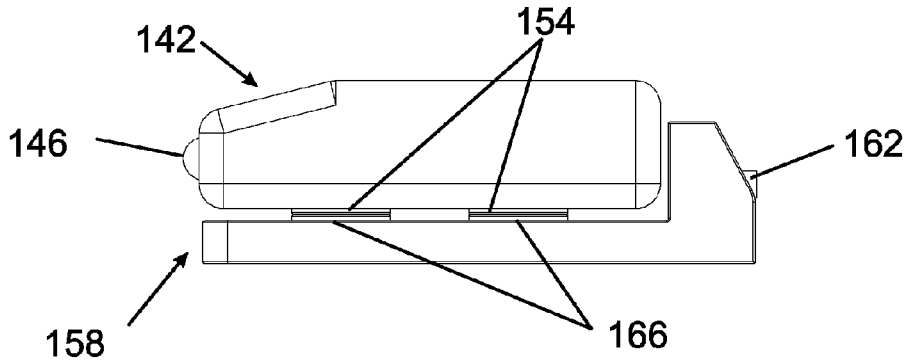

Referring now to FIG. 12, a drawing of a light base 158 which may be used in combination with the light 142 is shown. The light base 158 includes a switch 162 and two magnets 166 which are mounted to a body. One magnet 166 is electrically connected to one side of the switch 162 and the other magnet 166 is electrically connected to the other side of the switch 162 such as with wire. When the switch 162 is closed, the magnets 166 are placed in electrical contact with each other. The magnets 166 are disposed in a pattern corresponding to the magnets 154 on the light 142. The light 142 may be attached to the light base 158 by attaching the magnets 154 to the magnets 166. When the switch 162 is open, the LED 146 is not connected to the battery 150 in a complete circuit. When the switch 162 is closed, the electrical circuit is completed and the battery 150 provides electricity to the LED to produce light. The light base 158 may be used to illuminate the LED and produce light when it is not convenient to attach the light 142 to a conductive magnetically attracted object. If desired, the magnets 166 may be replaced with iron or steel or another material which is attracted to magnets.

Figure 13A:
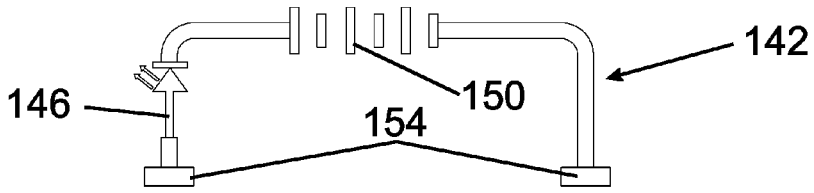
FIGS. 13A and 13B show schematic drawings of the magnetic light and base.
Figure 13B:
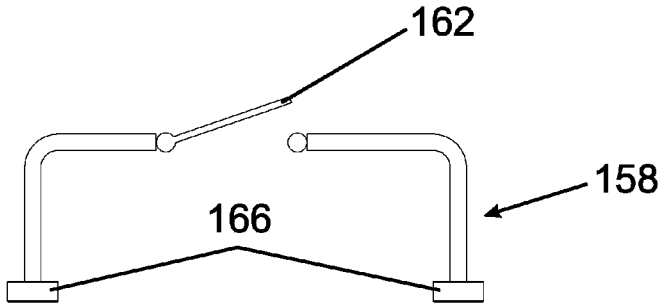

Referring now to FIG. 13A, a representative electrical schematic for the light 142 is shown. As discussed, the LED 146 is electrically connected to a magnet 154 and a battery 150. The battery 150 is electrically connected to the other magnet 154. A resistor may be used as necessary to govern the current through the LED 146. The electrical circuit is completed whenever the two magnets 154 are electrically connected to each other and the battery 150 then illuminates the LED 146. Referring now to FIG. 13B, a representative electrical schematic for the light base 158 is shown. The magnets 166 may be connected to each other via wire and a switch 162.

Figure 14A:
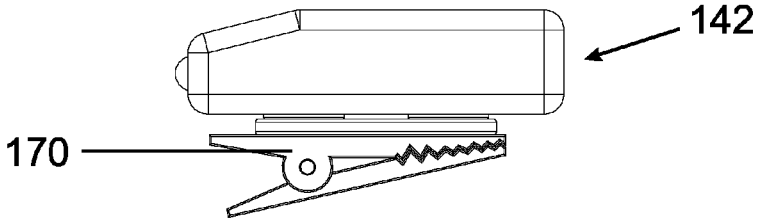
FIGS. 14A and 14B show drawings of a magnetic light and light base.
Figure 14B:
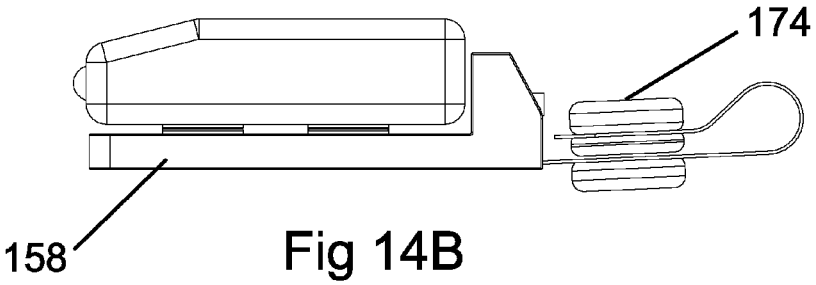

Referring now to FIGS. 14A and 14B, drawings of the light 142 used with a clip or attachment loop are shown. As shown in FIGS. 14A and 14B, the light base 158 may be provided with a clip 170 such as an alligator clip or a ring/loop 174 to allow the light base 158 and light 142 to be attached to a lanyard, hat, etc. The alligator clip 170 may be of sufficient size to receive the magnets 154 or may have a larger metal piece attached thereto such that the magnets 154 may be attached directly to the clip 170 and illuminate the light 142 if desired. This allows a person to position the light 142 as desired for use. The loop 174 allows a person to conveniently carry the light 142 without accidentally illuminating the LED 146; such as by accidentally placing the light 142 in a pocket adjacent keys.

There is thus disclosed an improved light and magnetic connection socket. A quick and convenient light with multiple different beam patterns and lighting options is provided. The light system allows a person maximum flexibility in mounting the light in a desired location. It will be appreciated that numerous changes may be made to the present invention without departing from the scope of the claims.

What is claimed is:

1. A modular lighting system comprising:

a battery module, the battery module comprising:

a body;

a battery disposed in the body; and a socket, the socket comprising a first ring shaped magnet and a first pin disposed in the center of the ring shaped magnet, the first ring shaped magnet and the first pin being electrically connected to the battery;

a light module selectively attachable to the battery module to form a flashlight, the light module comprising:

a body;

a light mounted to the body and operable to provide illumination; and a plug, the plug comprising a second ring shaped magnet and a second pin disposed in the center of the ring magnet;

wherein the plug is insertable into the socket to connect the light module to the battery module;

wherein the first ring shaped magnet is magnetically attracted to the second ring shaped magnet to thereby hold the plug into the socket;

wherein the first pin and the second pin contact each other to transmit electricity therebetween; and wherein the first ring magnet and the second ring magnet contact each other to transmit electricity therebetween.

2. The modular lighting system of claim 1, wherein the socket further comprises a first insulating plate disposed generally perpendicular to an opening of the socket, wherein the first ring shaped magnet is disposed in a groove formed in the first insulating plate, and wherein the first pin is disposed in a hole formed in the first insulating plate.

3. The modular lighting system of claim 2, further comprising a spring attached to the first pin, the spring being disposed to push the pin outwardly beyond a face of the first insulating plate.

4. The modular lighting system of claim 1, wherein the first ring shaped magnet and the first pin are disposed in a plane which is perpendicular to a bore of the socket.

5. The modular lighting system of claim 1, further comprising a second light module selectively attachable to the battery module to form a flashlight, the second light module comprising:

a body;

a light mounted to the body and operable to provide illumination which is different than the first light module light; and a plug, the plug comprising a ring shaped magnet and a pin disposed in the center of the ring magnet;

wherein either the first light module plug or the second light module plug is selectively insertable into the socket to connect either the first light module or the second light module to the battery module.

6. The modular lighting system of claim 1, further comprising an extension module comprising:

a first body forming a socket, the socket comprising a first ring shaped magnet and a first pin disposed in the center of the ring shaped magnet;

a second body forming a plug, the plug comprising a second ring shaped magnet and a second pin disposed in the center of the ring magnet;

a length of flexible wire disposed between the first body and the second body, the wire having a first conductor which is electrically connected to the first ring shaped magnet and the second ring shaped magnet and a second conductor which is electrically connected to the first pin and the second pin;

wherein the extension module plug is insertable into the battery module socket and the light module plug is insertable into the extension module socket to connect the light module to the battery module via the extension module whereby the light module is physically separated from the battery module.

7. The modular lighting system of claim 6, wherein the extension module comprises a magnet attached to the first body, the magnet allowing the first body and the light module to be attached to an object for use.

8. The modular lighting system of claim 1, wherein the first ring shaped magnet and the first pin are recessed from an opening of the socket.

9. The modular lighting system of claim 1, wherein the battery module body forms a flashlight handle and wherein the light module body forms an enclosure which houses the light and which forms the light module plug.

10. A modular lighting system comprising:

a battery module, the battery module comprising:

a body forming a flashlight handle;

a battery disposed in the body; and a first magnet attached to the body, the first magnet being electrically connected to the battery;

a body electrical contact disposed adjacent the magnet, the body electrical contact being electrically connected to the battery;

a light module selectively attachable to the battery module to form a flashlight, the light module comprising:

a body forming a housing;

a light disposed in the body and operable to provide illumination;

a first electrical contact, the first electrical contact being formed from a material which is attracted to a magnet;

a second electrical contact;

wherein the first electrical contact and the second electrical contact are electrically connected to the light;

wherein the light module is attached to the battery module by placing the first electrical contact adjacent the first magnet such that the first magnet holds the first electrical contact by magnetic attraction and such that the first magnet holds the second electrical contact against the body electrical contact; and wherein electricity flows through the first magnet and the first electrical contact and flows through the body electrical contact and the second electrical contact to illuminate the light.

11. The modular lighting system of claim 10, wherein the battery module body forms a socket, and wherein the first magnet and the body electrical contact are disposed in the socket.

12. The modular lighting system of claim 11, wherein the light module body forms a plug, wherein the first electrical contact and the second electrical contact are disposed on an end of the plug such that the first electrical contact touches the first magnet and the second electrical contact touches the body electrical contact when the plug is inserted into the socket.

13. The modular lighting system of claim 12, wherein the plug and socket are round, and wherein the first magnet, body electrical contact, first electrical contact, and second electrical contact have radial symmetry so that the plug may be functionally inserted into the socket in any rotational position.

14. The modular lighting system of claim 10, wherein the first magnet is ring shaped and wherein the body electrical contact is a first pin disposed in a center of the first magnet and electrically isolated therefrom.

15. The modular lighting system of claim 10, wherein the first electrical contact is a magnet.

16. A modular lighting system comprising:

a light module having a body;

a light disposed in the body to provide illumination to a user when the light is illuminated;

a battery;

a first magnet which is electrically connected to the battery;

a body electrical contact disposed adjacent the first magnet; and wherein electricity flows between the battery and the light through the first magnet and the electrical contact to power the light.

17. The modular lighting system of claim 16, wherein the battery is disposed in the body, wherein the first magnet and the body electrical contact are disposed adjacent each other on the body, and wherein the first magnet is used to attach the light module to a magnetically attracted object which thereafter conducts electricity between the first magnet and the body electrical contact to thereby connect the battery to the light.

18. The modular lighting system of claim 16, wherein:

the first magnet and the body electrical contact are disposed on a battery module body;

wherein the battery is disposed in the battery module body;

wherein the system further comprises a first electrical contact and a second electrical contact which are disposed on the light module body;

wherein the first electrical contact is held against the first magnet by magnetic attraction to thereby attach the light module to the battery module such that the first magnet contacts the first electrical contact and the body electrical contact contacts the second electrical contact; and wherein electricity flows through the battery and the first electrical contact to illuminate the light.

* * * * *